US010208438B2

(12) United States Patent
Peeters

(10) Patent No.: US 10,208,438 B2
(45) Date of Patent: Feb. 19, 2019

(54) COMPOSITE BRIDGE DECK AND BRIDGE CONSTRUCTION

(71) Applicant: FiberCore IP B.V., Rotterdam (NL)

(72) Inventor: Johannes Hendricus Alphonsus Peeters, Rotterdam (NL)

(73) Assignee: FiberCore IP B.V., Rotterdam (NL)

( * ) Notice: Subject to any disclaimer, the term of this patent is extended or adjusted under 35 U.S.C. 154(b) by 0 days.

(21) Appl. No.: 15/548,124

(22) PCT Filed: Feb. 22, 2016

(86) PCT No.: PCT/NL2016/050126
§ 371 (c)(1),
(2) Date: Aug. 2, 2017

(87) PCT Pub. No.: WO2016/137318
PCT Pub. Date: Sep. 1, 2016

(65) Prior Publication Data

US 2018/0016759 A1 Jan. 18, 2018

(30) Foreign Application Priority Data

Feb. 23, 2015 (NL) ..... 2014337

(51) Int. Cl.
*E01D 19/00* (2006.01)
*E01D 19/12* (2006.01)
(Continued)

(52) U.S. Cl.
CPC ..... *E01D 19/125* (2013.01); *E01D 19/02* (2013.01); *E04B 5/026* (2013.01); *E01D 19/04* (2013.01);
(Continued)

(58) Field of Classification Search
CPC ... E01D 19/125; E01D 19/04; E01D 2101/40; E01D 19/02; E04B 5/026; E04C 2003/0439; E04C 2003/0465
(Continued)

(56) References Cited

U.S. PATENT DOCUMENTS 3,529,393 A 9/1970 Wilkins
4,033,005 A * 7/1977 Czernik ..... E01D 19/042 14/73.5
(Continued)

FOREIGN PATENT DOCUMENTS

CA 2557701 A1 2/2008
EP 1947259 A1 7/2008
(Continued)

*Primary Examiner* — Raymond W Addie
(74) *Attorney, Agent, or Firm* — Tamara C. Stegmann; Catherine A. Shultz; N.V. Nederlandsch Octrooibureau

(57) ABSTRACT

A bridge construction having a bridge support or abutment and a bridge deck supported thereon. The bridge deck includes a composite panel with a top plastic skin, a bottom plastic skin and a core arranged between and attached to the plastic skins. The bridge deck also includes an edge beam extending along at least one edge of the composite panel and resting on the bridge support. The top plastic skin has a protruding part which protrudes laterally relative to the core and the bottom plastic skin. The protruding part of the top plastic skin extends over and is attached to a top side of the edge beam, and both the core and the lower plastic skin extend laterally up to a front side of the edge beam.

19 Claims, 2 Drawing Sheets

(51) Int. Cl.

| | |
|---|---|
| ***E01D 19/02*** | (2006.01) |
| ***E04B 5/02*** | (2006.01) |
| *E01D 101/40* | (2006.01) |
| *E04C 3/04* | (2006.01) |
| *E01D 19/04* | (2006.01) |

(52) U.S. Cl.
CPC .. *E01D 2101/40* (2013.01); *E04C 2003/0439* (2013.01); *E04C 2003/0465* (2013.01)

(58) Field of Classification Search
USPC ..... 14/73–74.5, 77.1
See application file for complete search history.

(56) References Cited

U.S. PATENT DOCUMENTS

| | | | | |
|---|---|---|---|---|
| 4,186,535 | A * | 2/1980 | Morton | E04B 1/24 52/250 |
| 5,052,164 | A * | 10/1991 | Sandow | E04C 2/34 52/306 |
| 6,023,806 | A | 2/2000 | Dumlao et al. | |
| 6,081,955 | A * | 7/2000 | Dumlao | B63B 5/24 14/73 |
| 6,453,495 | B1 | 9/2002 | Meggers et al. | |
| 7,296,317 | B2 * | 11/2007 | Grace | E01D 2/04 14/73 |
| 8,020,235 | B2 * | 9/2011 | Grace | E01D 2/02 14/73 |
| 2001/0037533 | A1 | 11/2001 | Doyle et al. | |
| 2002/0010973 | A1 | 1/2002 | Dumlao et al. | |
| 2002/0020033 | A1 | 2/2002 | Lang | |
| 2003/0084523 | A1 | 5/2003 | Szekely | |
| 2008/0078038 | A1 * | 4/2008 | Borazghi | B23B 3/26 14/73 |
| 2012/0000020 | A1 | 1/2012 | Newton | |

FOREIGN PATENT DOCUMENTS

| | | | |
|---|---|---|---|
| GB | 150061 | A | 8/1920 |
| WO | 2011053126 | A1 | 5/2011 |

* cited by examiner

COMPOSITE BRIDGE DECK AND BRIDGE CONSTRUCTION

TECHNICAL FIELD

The invention relates to a bridge deck comprising a composite panel with a top plastic skin, a bottom plastic skin and a core between and attached to the plastic skins, and an edge beam on at least one edge of the composite panel.

BACKGROUND ART

Such a bridge deck is known. The composite panel thereof is often provided with steel edge beams at the edges. These steel edge beams may extend transversely to the longitudinal direction of the bridge deck, and conduct the forces which result from the weight of the bridge deck and the weight of the road traffic travelling over the bridge deck. The concentrated imposition forces which occur at the site of the support of the edge beam on the bridge support can therefore be distributed regularly over the composite panel. Also, such edge beams may be provided at the longitudinal edges of the composite panel.

Although a bridge deck produced in this way is ideal for heavy traffic, it is found however in practice that, in the long term, problems can occur at the site of the transition from the steel edge beam to the composite material of the bridge deck. These problems are partly caused by the fact that the steel edge beam has a greater stiffness than the composite material. The forces exerted on the bridge construction from the wheel loads of the road traffic therefore lead to uneven deformations occurring at the transition between the steel edge beam and the composite material. The steel edge beam deforms to a lesser extent than the composite material, such that the adhesion between the components is continuously subjected to alternating loads. In the end, the adhesion can fail.

The resulting crack formation in the surface of the bridge deck allows moisture to seep in, such that corrosion and further cracking can occur in frost.

It is therefore desirable to create an improved bridge deck. Furthermore, it may be desirable to create a bridge deck which is less susceptible to differences in deformation which occur between the steel parts and the composite parts thereof. It may also be desirable to create a bridge deck in which cracking under the influence of alternating loads is countered.

SUMMARY OF INVENTION

According to a first aspect of the invention, a bridge deck is provided comprising a composite panel with a top plastic skin, a bottom plastic skin and a core between and attached to the plastic skins, and an edge beam on at least one edge of the composite panel. The edge beam overlaps the core of the composite panel in the height direction, the top plastic skin has a protruding part which protrudes relative to the core, and the protruding part of the top plastic skin extends over and is attached to the edge beam.

In the bridge deck according to this aspect, the top layer of the composite panel is configured such that this layer extends relative to the core of the composite panel. The top layer, in contrast to the core, does not butt up against the steel edge beam but extends over this. The steel edge beam thus forms a component of the bridge deck which is fully concealed below the top layer of the composite panel. The top layer of the composite panel, in other words the protruding part of the top plastic skin, completely covers the edge beam. As a result, wheel contact only occurs on the surface of the top layer, resulting in a more uniform load development from the bridge deck to the adjacent abutment and vice versa.

In contrast to the known bridge decks, there are no significant differences in deformation, which helps to safeguard the integrity of the bridge deck. As a result, there is no or virtually no cause for crack formation, and seepage of moisture and local freezing are avoided.

The core may butt up against the edge beam or against a filling layer, such as an adhesive layer, with which the edge beam is coated or covered at least partially. In particular, the composite panel may comprise a bulkhead that delimits the core and where applicable the plastic skins, which bulkhead then lies against the edge beam or against a filling layer, such as an adhesive layer, with which the edge beam is coated or covered at least partially. Such a bulkhead is, however, not necessary. In the absence of a bulkhead, the bottom plastic skin and the core butt up against the edge beam or against the filling layer directly.

By means of the adhesive layer, the composite panel may be attached reliably and in a sealing manner to the steel edge beam. In addition, mutually aligned openings may be present in the protruding part of the top plastic skin and the edge beam. A peg or bolt may extend through each pair of an opening in the top plastic skin and an opening in the edge beam which are aligned to each other. If the edge beam has a top support surface on which the top plastic skin is supported, the openings may be located therein. The edge beam may comprise a top flange, and the support surface may be at least partially defined by this top flange. The openings may then be defined in this top flange.

Furthermore, the edge beam may have a bottom flange on which the bottom skin is supported. This bottom plastic skin and the bottom flange may also have mutually aligned openings; a peg may extend through each pair of an opening in the bottom plastic skin and an opening in the bottom flange.

In this way, a positive mechanical connection is ensured between the edge beam and the composite panel. In a preferred embodiment, the openings may form a row of pairs of openings. This row extends in the longitudinal direction of the edge beam. Of this row, at least one pair of openings and the associated peg cooperate closely so as to ensure a fixed position of the edge beam and the composite panel relative to each other. The other pairs of openings however have the form of a slot, the largest dimension of which is directed in the longitudinal direction of the edge beam, to compensate for the expansion differences between the edge beam and the composite panel.

At the free edge of the protruding part of the top plastic skin and the edge beam, an angle profile may be provided, one leg of which covers the top surface of the protruding part or a cover layer located on the protruding part, and the other leg of which extends along the border of the protruding part of the top plastic skin, the edge beam and any cover layer present on the protruding part. Such an angle profile offers further protection of the laminate of cover layer, top plastic skin and flange of the edge beam.

The edge beam may be configured with various cross sections. An example is an edge beam with a box section, relative to which the top flange and the bottom flange protrude. The openings for the bolt or peg may be located in the top flange but may also open into the box section. Other forms without box section, such as a Z-shaped edge beam, are however also possible.

According to another aspect, the invention concerns an edge beam for the bridge construction described above, comprising a top side and a bottom side, a front side for facing the composite panel and a back side opposite this, wherein the top side has a row of openings extending in the longitudinal direction, in each of which a peg can be received, wherein the front side is provided with a bottom flange which faces away from the back side, in which bottom flange a row of openings is located, in each of which a peg can be received.

The bottom flange is preferably at a non-zero distance from the top side and from the bottom side of the edge beam viewed in the height direction thereof. Furthermore, the top side of the edge beam may comprise a top flange which protrudes relative to the rear side of the edge beam and which faces away from the front side of the edge beam, in which top flange the row of openings is located. Preferably, the edge beam is box shaped, relative to which the top and bottom flanges protrude.

According to yet another aspect of the invention, there is provided a composite panel for the bridge construction as described above. The composite panel comprises a top plastic skin, a bottom plastic skin, and a core between and attached to the plastic skins. The top plastic skin has a protruding part which protrudes relative to the core.

A row of openings, in which a peg may be received, may be located in the protruding part of the top plastic skin. Also, the bottom plastic skin may contain a row of openings which runs parallel to the row of openings in the protruding part of the top plastic skin, wherein the distance between the row of openings and the edge of the core adjacent to the protruding part of the top plastic skin is of the same order of magnitude as the width of the protruding part.

BRIEF DESCRIPTION OF DRAWINGS

Embodiments will now be described, by way of example only, with reference to the accompanying schematic drawings in which corresponding reference symbols indicate corresponding parts.

The figures are meant for illustrative purposes only, and do not serve as restriction of the scope or the protection as laid down by the claims.

DESCRIPTION OF EMBODIMENTS

The following is a description of exemplary embodiments of the invention, given by way of example only and with reference to the figures.

Figure 1:
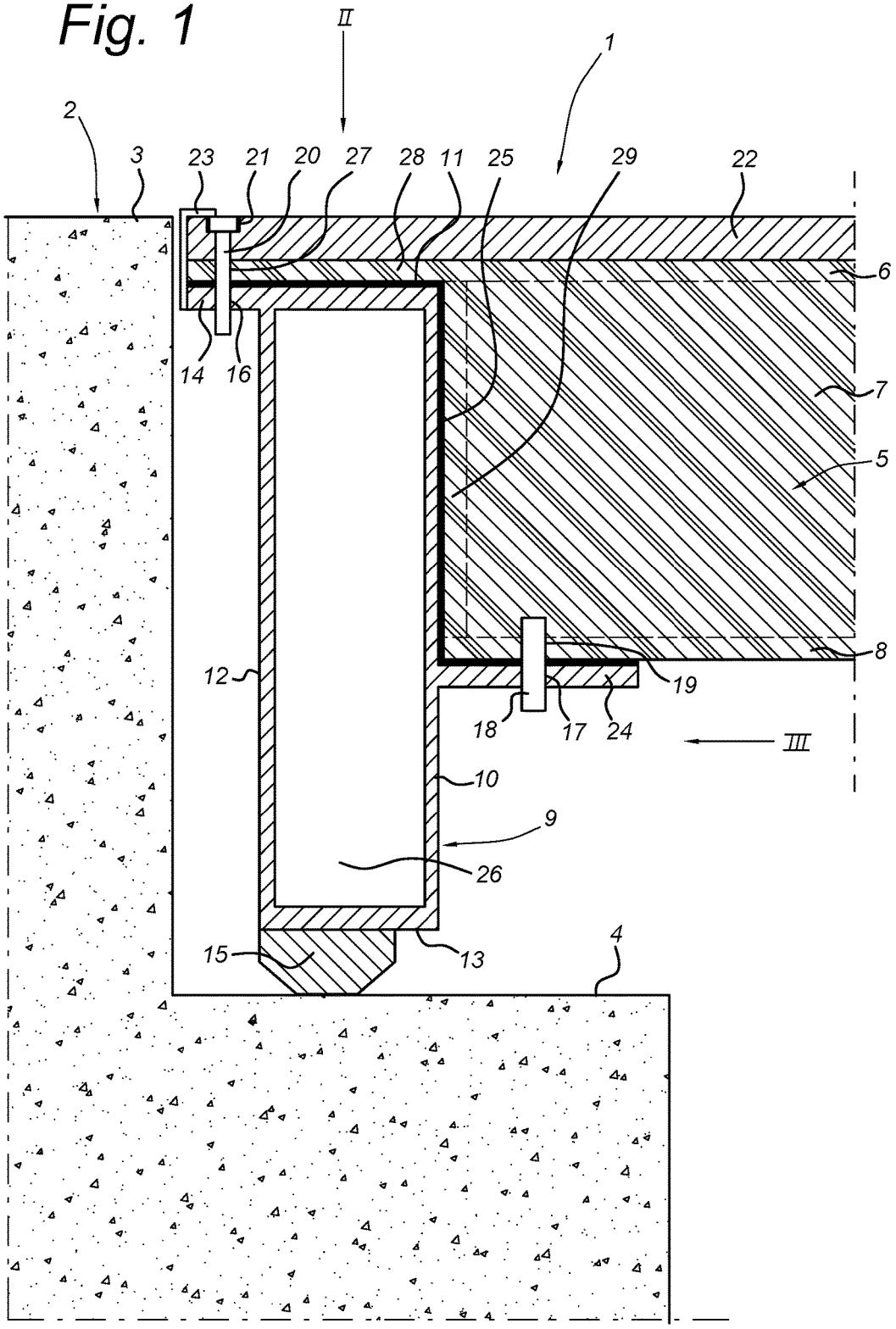
FIG. 1 shows a vertical cross section through the bridge construction according to an embodiment of the invention, with bridge deck and abutment.

FIG. 1 shows in vertical cross section, a bridge deck 1 with an abutment 2 which in the example shown has a road surface 3 and a support 4 for the bridge deck 1 at a lower level. The bridge deck 1 itself is formed by a composite panel 5, known in itself, together with the steel edge beam 9. This composite panel diagrammatically comprises the top plastic skin 6, a bottom plastic skin 8 and the core 7 in-between. Around this, a bulkhead 29 is provided. This bulkhead 29 and the bottom plastic skin 8 of the composite panel 5 abut the front side 10 of the edge beam 9. The top plastic skin 6 extends with the protruding part 28 past the core 7 to over the top side 11 of the edge beam 9.

The edge beam 9 has a bottom flange 24 on its front side 10. On the opposing back side 12 of the edge beam 9 is a top flange 14 which connects to the top side 11 of the edge beam 9. The bottom side 13 of the edge beam 9 has support ridges 15 with which the bridge deck 1 is supported on an abutment 2. Said top side 11, bottom side 13, front side 10, and back side 12 in the example shown define the box section, indicated as a whole as 26, with rectangular cross section. Other cross sections are, however, possible for this box section. Furthermore, cross sections are possible without box section, such as a Z-shaped edge beam.

Figure 2:
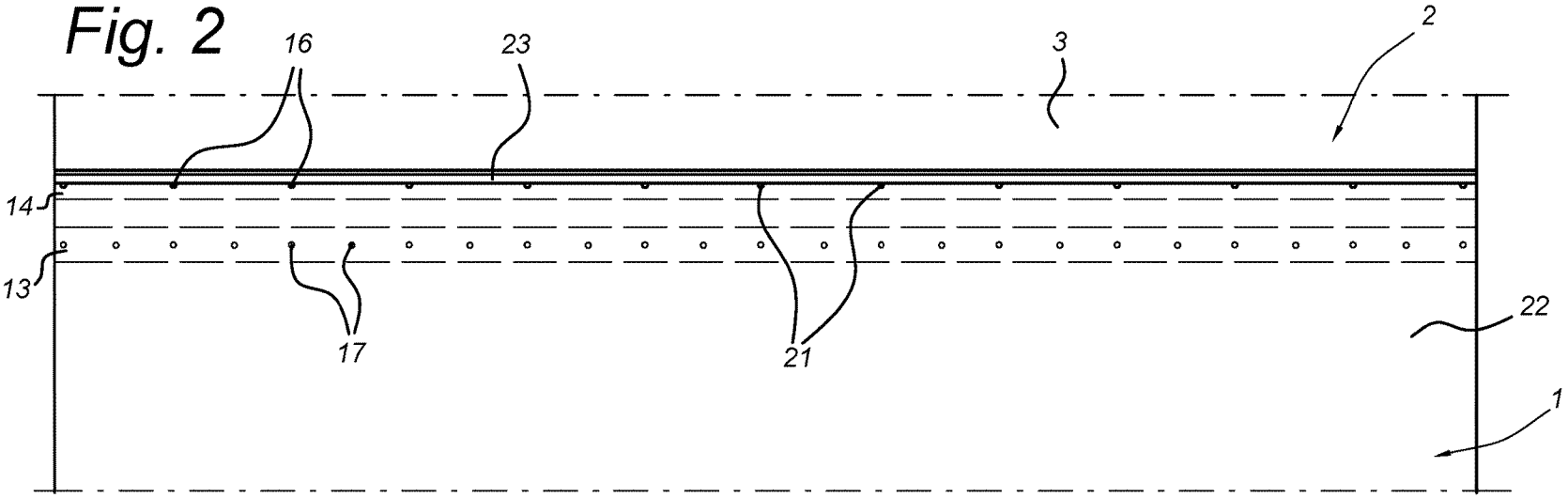
FIG. 2 shows the top view according to II of FIG. 1.
Figure 3:
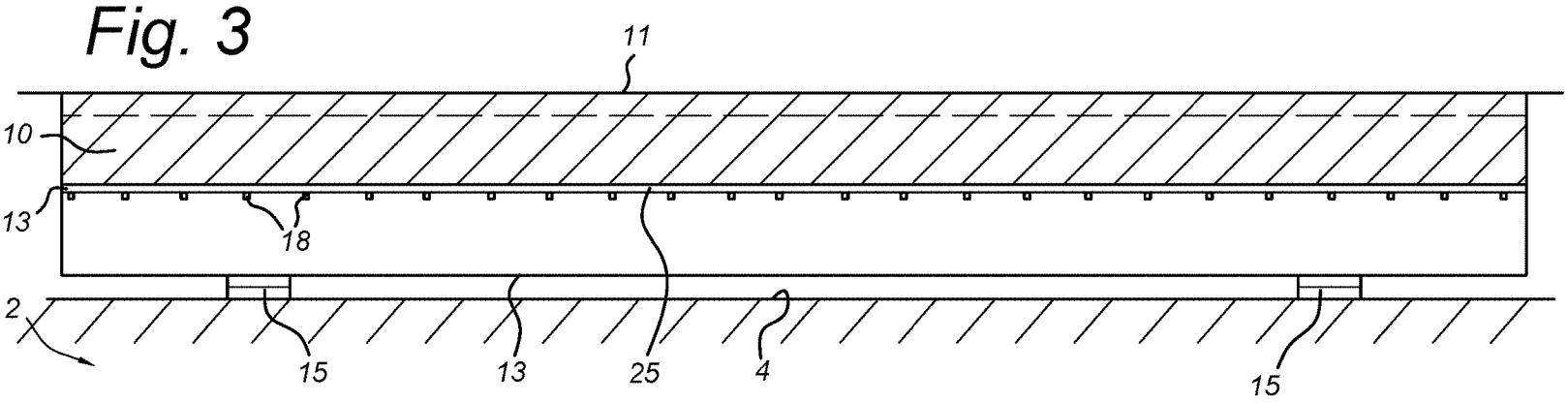
FIG. 3 shows a front view of an edge beam wherein the composite panel has been removed.

The top flange 14 has a row of holes 16, as shown in the top view of FIG. 2. The bottom flange 24 also has a row of holes 17 as shown in FIG. 2. Pegs 18 are received in the holes 17 of the bottom flange 24 and extend into holes 19 in the bottom plastic skin 8 of the composite panel 5. Bolts 20 are inserted in the holes 16 of the top flange 14 and in the openings 27 of the protruding part 28 of the top plastic skin 6, the heads of which bolts are countersunk in recesses 21. These bolts 20 extend through the road surface 22 which is applied on the top plastic skin 6, through the protruding part 28 of the top plastic skin 6, and through the top flange 14. An angle iron 23 is applied over the top edge formed by the top support flange 14, the protruding part 28 of the top plastic skin 6 and the road surface 22, and also partly covers the heads of the bolts 20.

The top plastic skin 6 and the road surface 22 thus extend from the core 7 of the composite panel 5 continuously to the transition to the road surface 3 on the abutment 2. There will therefore be no wheel contact with the edge beam 9 so that a uniform transition for the wheel loads from the composite panel 5 to the abutment 2 is obtained. Differential deformation between the edge beam 9, which normally consists of steel, and the composite panel 5 consisting of plastic is thus reduced or even avoided, yielding a bridge construction with an improved resistance to fatigue.

An adhesive layer 25 may also be provided between the composite panel 5 thus formed and the adjacent surfaces of the edge beam 9. Although, in the exemplary embodiment shown, the edge beam 9 is located at the edge of the composite panel which faces the abutment, such edge beams may alternatively or additionally also be placed at the other edges of the composite panel.

It should be clear that the embodiments described above are described merely by way of example and are not in any way restrictive, and that various modifications and adaptations are possible without leaving the scope of the invention, and that the scope is determined only by the attached claims.

LIST OF REFERENCE SYMBOLS

1. Bridge deck
2. Abutment
3. Road surface on abutment
4. Abutment support
5. Composite panel
6. Top plastic skin
7. Core
8. Bottom plastic skin
9. Edge beam
10. Front side of edge beam
11. Top side of edge beam
12. Back side of edge beam
13. Bottom side of edge beam
14. Top flange
15. Support ridge
16. Opening in top flange

17. Opening in bottom flange
18. Peg
19. Hole in bottom plastic skin
20. Bolt
21. Opening for bolt head
22. Road surface
23. Angle iron
24. Bottom flange
25. Adhesive layer
26. Box section
27. Opening in top plastic skin
28. Protruding part of top plastic skin
29. Bulkhead

The invention claimed is:

1. A bridge deck comprising a composite panel with a top plastic skin, a bottom plastic skin, and a core arranged between and attached to the plastic skins, and an edge beam extending along an edge of the composite panel, wherein the top plastic skin has a protruding part which protrudes laterally relative to both the core and the bottom plastic skin, wherein the protruding part of the top plastic skin extends over and is attached to a top side of the edge beam, and wherein both the core and the lower plastic skin extend laterally up to a front side of the edge beam.

2. The bridge deck according to claim 1, wherein the core and the bottom plastic skin butt up against said front side of the edge beam or against a filling layer that covers said front side of the edge beam.

3. The bridge deck according to claim 1, wherein the protruding part of the top plastic skin completely covers the top side of the edge beam.

4. The bridge deck according to claim 1, wherein an angle profile is provided at the free edge of the protruding part of the top plastic skin and the edge beam, wherein one leg of the angle profile covers a top surface of the protruding part or a cover layer located on the protruding part, and wherein a further leg of the angle profile extends along a boundary edge of the protruding part of the top plastic skin, the edge beam and any cover layer present on the protruding part.

5. The bridge deck according to claim 1, wherein the composite panel comprises, a top plastic skin, a bottom plastic skin, and a core arranged between and attached to the plastic skins, wherein the top plastic skin has a protruding part which laterally protrudes relative to both the core and the bottom plastic skin, and wherein the protruding part of the top plastic skin includes a row of openings, configured to receive a peg or bolt.

6. The bridge deck according to claim 5, wherein the bottom plastic skin includes a row of lower openings which extends parallel to the row of openings in the protruding part of the top plastic skin, wherein a distance between the row of openings and a edge of the core adjacent to and below the protruding part of the top plastic skin is of the same order of magnitude as a width of the protruding part.

7. The bridge deck according to claim 1, wherein the composite panel comprises a bulkhead that delimits the core, wherein said bulkhead abuts said front side of the edge beam or a filling layer that covers said front side of the edge beam.

8. The bridge deck according to claim 7, wherein the filling layer is an adhesive layer.

9. The bridge deck according to claim 1, wherein the protruding part of the top plastic skin includes openings, wherein the edge beam includes further openings, each of said further openings being aligned with a respective one of said openings, and wherein a peg or bolt extends through each respective pair of aligned openings and further openings.

10. The bridge deck according to claim 9, wherein the top side of the edge beam includes said further openings.

11. The bridge deck according to claim 10, wherein the edge beam has a top flange that at least partly defines the top side of the edge beam, and wherein the top flange includes the further openings.

12. The bridge deck according to claim 10, wherein a row of pairs of openings is provided which extends in the longitudinal direction of the edge beam, of which row at least one pair of openings and the associated peg cooperate closely and other pairs of openings have at least one opening in the form of a slot, the largest dimension of which is directed in the longitudinal direction of the support beam, to compensate for the expansion differences between the edge beam and the composite panel.

13. The bridge deck according to claim 1, wherein the edge beam has a bottom flange on which the bottom plastic skin is supported.

14. The bridge deck according to claim 13, wherein the bottom plastic skin and the bottom flange have lower openings and further lower openings, respectively, wherein each lower opening is aligned with a corresponding further lower opening, and wherein a peg extends through each pair of a lower opening in the bottom plastic skin and an further lower opening in the bottom support flange.

15. A bridge construction comprising a bridge support or abutment for supporting the bridge deck according to claim 1, the bridge deck comprising a composite panel with a top plastic skin, a bottom plastic skin, and a core arranged between and attached to the plastic skins, and an edge beam extending along an edge of the composite panel and resting on the bridge support, wherein the top plastic skin has a protruding part which laterally protrudes relative to both the core and the bottom plastic skin, wherein the protruding part of the top plastic skin extends over and is attached to a top side of the edge beam, and wherein both the core and the lower plastic skin extend up to a front side of the edge beam.

16. An edge beam for a bridge deck according to claim 1, with a top side and a bottom side, a front side for facing the composite panel, and a back side opposite to the front side, wherein the top side has a row of further openings extending in the longitudinal direction, each further opening being configured to receive a peg or bolt, wherein the front side is provided with a bottom flange which protrudes from the front side and in a lateral direction away from the back side, wherein said bottom flange includes a row of further lower openings is, each further lower opening being configured to receive a peg.

17. The edge beam according to claim 16, comprising a box section that defines said front side from which the bottom flange protrudes.

18. The edge beam according to claim 16, wherein the bottom flange is located at non-zero distances from the top side and from the bottom side, viewed in a height direction of the edge beam.

19. The edge beam according to claim 18, wherein the top side has a top flange which protrudes from the back side and in an opposite lateral direction away from the front side, wherein said top flange includes the row of further openings.

* * * * *